US006550866B1

(12) United States Patent
Su

(10) Patent No.: US 6,550,866 B1
(45) Date of Patent: Apr. 22, 2003

(54) CHAIR BACKREST WITH VENTILATING FUNCTION

(76) Inventor: Tung-Hua Su, No. 12, Alley 10, Lane 27, Min Sheng 12$^{th}$ St., Kuwi Jen Hsiang, Tainan Hsien (TW)

( * ) Notice: Subject to any disclaimer, the term of this patent is extended or adjusted under 35 U.S.C. 154(b) by 0 days.

(21) Appl. No.: 10/053,805

(22) Filed: Jan. 24, 2002

(51) Int. Cl.$^{7}$ ..... A47C 16/00

(52) U.S. Cl. ..... 297/452.42; 297/452.2; 297/452.56; 297/440.11; 297/452.64

(58) Field of Search ..... 297/452.18, 452.2, 297/452.42, 452.46, 452.47, 452.56, 452.57, 440.11, 452.64, 440.15

(56) References Cited

U.S. PATENT DOCUMENTS 3,604,752 A * 9/1971 Macknick
5,393,126 A * 2/1995 Boulva
5,609,395 A * 3/1997 Burch
6,113,186 A * 9/2000 Holmes et al.
6,254,190 B1 * 7/2001 Gregory

* cited by examiner

*Primary Examiner*—Laurie K. Cranmer
(74) *Attorney, Agent, or Firm*—Charles E. Baxley

(57) ABSTRACT

A chair backrest comprises a frame, a support member, and a net. The frame is a loop-like member and includes a groove. The frame further includes an engaging portion to be securely connected to a seat of a chair. The support member is made of rigid material and mounted in the groove. The support member includes an engaging piece securely connected to the engaging portion of the frame. The net is made of soft material. The net encloses the frame and includes a peripheral edge mounted along an outer peripheral face of the frame.

7 Claims, 6 Drawing Sheets

CHAIR BACKREST WITH VENTILATING FUNCTION

BACKGROUND OF THE INVENTION

1. Field of the Invention

The present invention relates to a chair backrest with ventilating function. In particular, the present invention relates to a chair backrest that provides improved integrity and improved support reliability after assembly and that allows addition of a pillow to increase comfort when supporting the user's head.

2. Description of the Related Art

Chairs are a necessity in daily life and there are a wide variety of chairs that provides improved sitting comfort and air-ventilating function. FIG. 6 of the drawings illustrates a conventional chair backrest for providing a ventilating function. The backrest includes a rigid hollow rectangular frame 1' and a net 2'. The net 2' is made of soft material and wraps the outer peripheral edge of the frame 1' tightly to thereby embrace the frame 1' and to thereby support a user when the user lies on the backrest with the net 2' providing a ventilating function.

The conventional backrest includes several drawbacks. First of all, the frame 1' might be deformed or even broken and thus injure the user when the lying force from the user is relatively large, as the user is only supported by the frame 1' that is located in the net 2'. Second, the shape of the backrest is confined to the shape of the frame 1', which is relatively monotonous. Further, the frame 1' is still visible via the openings or holes in the net 2', which adversely affects the aesthetically pleasing appearance.

SUMMARY OF THE INVENTION

An object of the present invention is to provide a chair backrest comprising a frame, a support member, and a net. The frame is a loop-like member and includes a groove. The frame further includes an engaging portion to be securely connected to a seat of a chair. The support member is made of rigid material and mounted in the groove. The support member includes an engaging piece securely connected to the engaging portion of the frame. The net is made of soft material. The net encloses the frame and includes a peripheral edge mounted along an outer peripheral face of the frame.

The engaging portion of the frame includes a receiving groove that is communicated with the groove. The engaging piece of the support member is inserted into the receiving groove via the groove.

A wall defining the groove includes plural fixing holes. The support member includes plural fixing holes. Fasteners are extended through the fixing holes of the groove and fixing holes of the support member.

The engaging portion includes plural engaging holes. A lid has plural engaging members for securely engaging with said plural engaging holes, thereby covering said plural fasteners.

The frame includes plural fixing holes. An outer member covers the net along the peripheral edge of the net. The outer member includes plural fixing holes. Fasteners are extended through the fixing holes of the frame and the fixing holes of the outer member.

The engaging piece includes plural fixing holes. The engaging portion includes plural fixing holes. An attachment plate includes a first end having plural fixing holes and a second end securely attached to the seat of the chair. Fasteners are extended through the fixing holes of the engaging portion, the fixing holes of the engaging piece, and the fixing holes of the attachment plate.

A pillow may be attached to the backrest to provide increased comfort when supporting the user's head.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
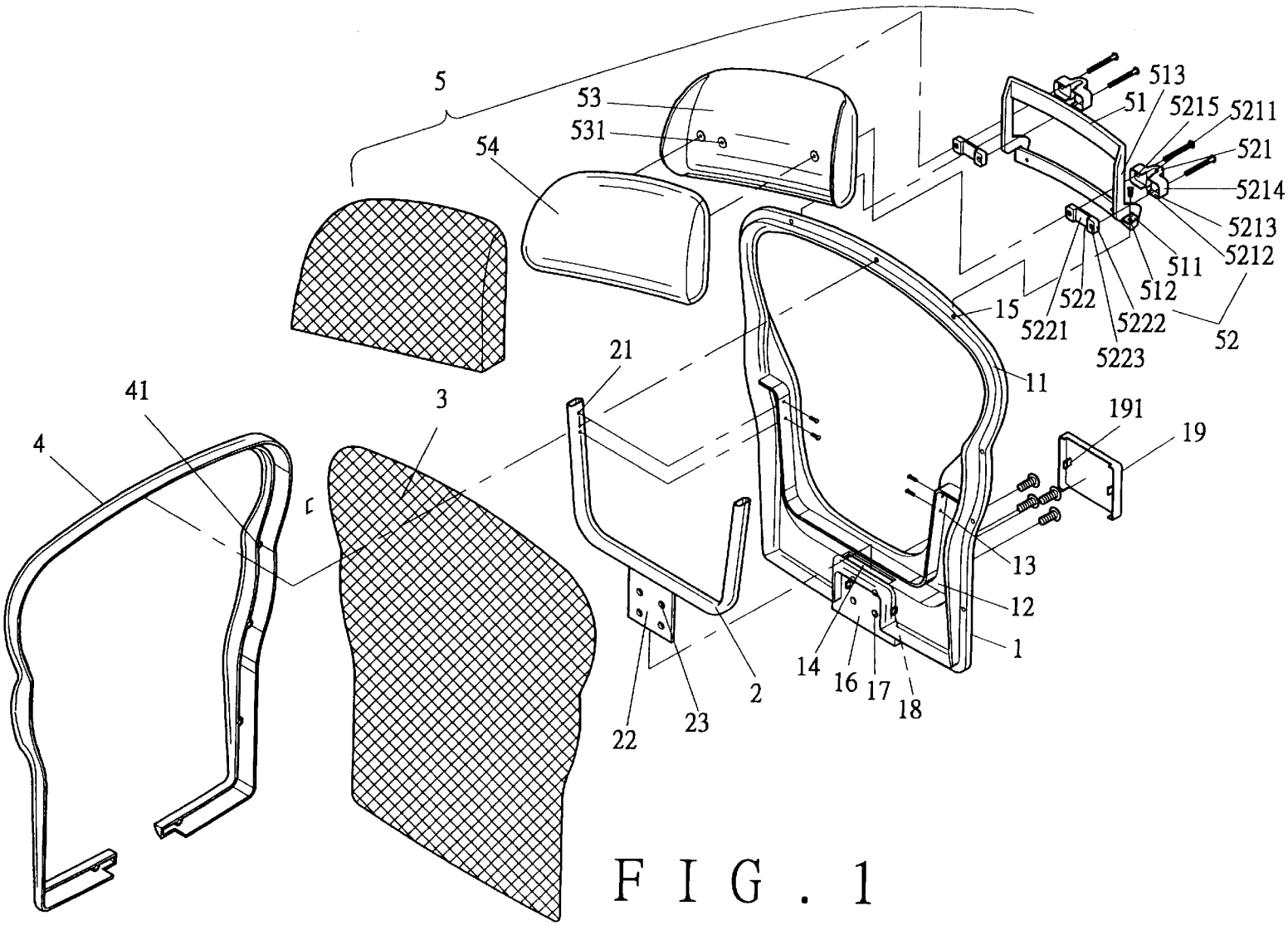
FIG. 1 is an exploded perspective view of a chair backrest in accordance with present invention.
Figure 2:
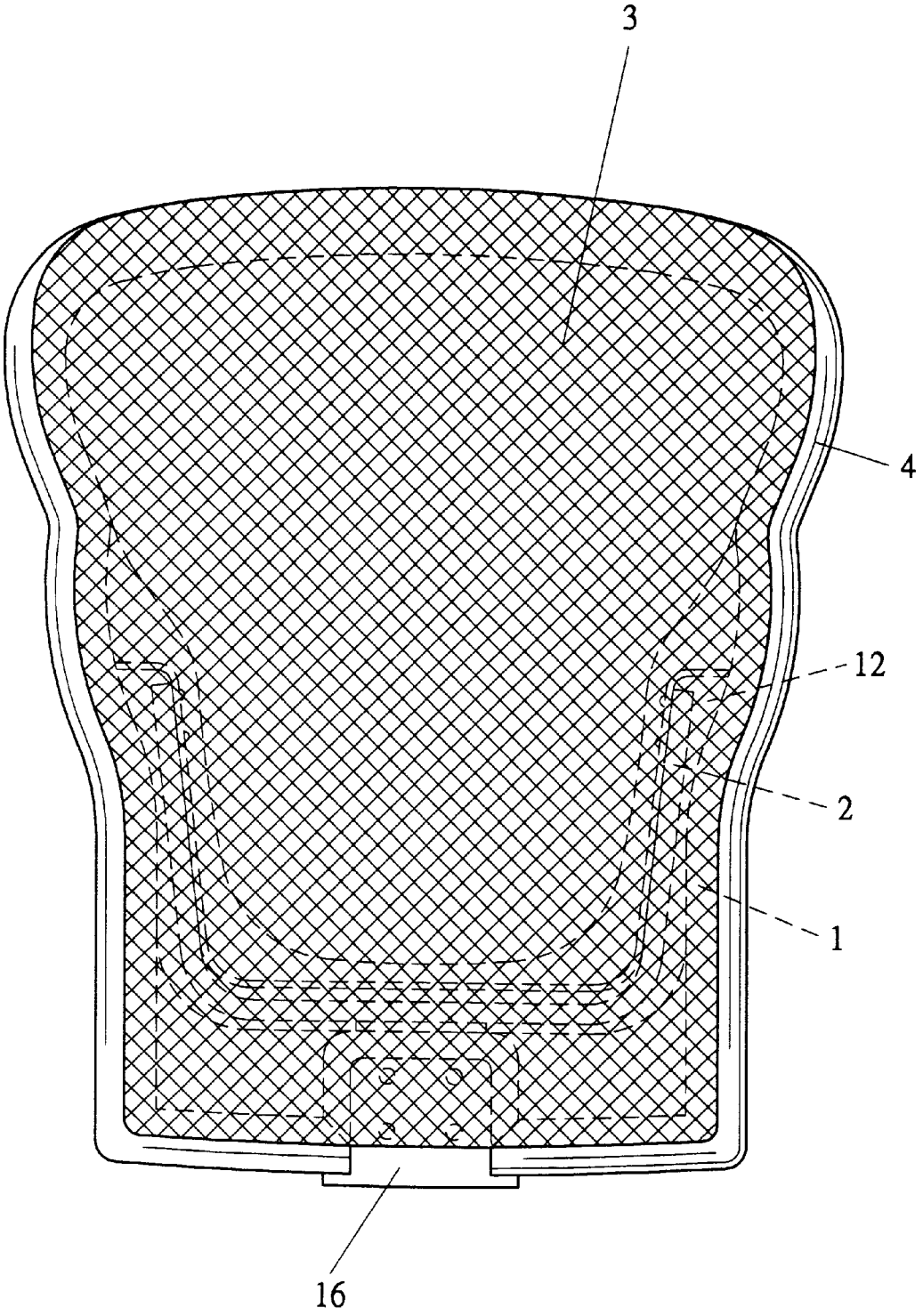
FIG. 2 is an elevational view of the chair backrest in accordance with the present invention.

Referring to FIGS. 1 through 5 and initially to FIGS. 1 and 2, a chair backrest in accordance with the present invention generally comprises a frame 1, a support member 2, a net 3, an outer member 4, and a pillow device 5.

Figure 3:
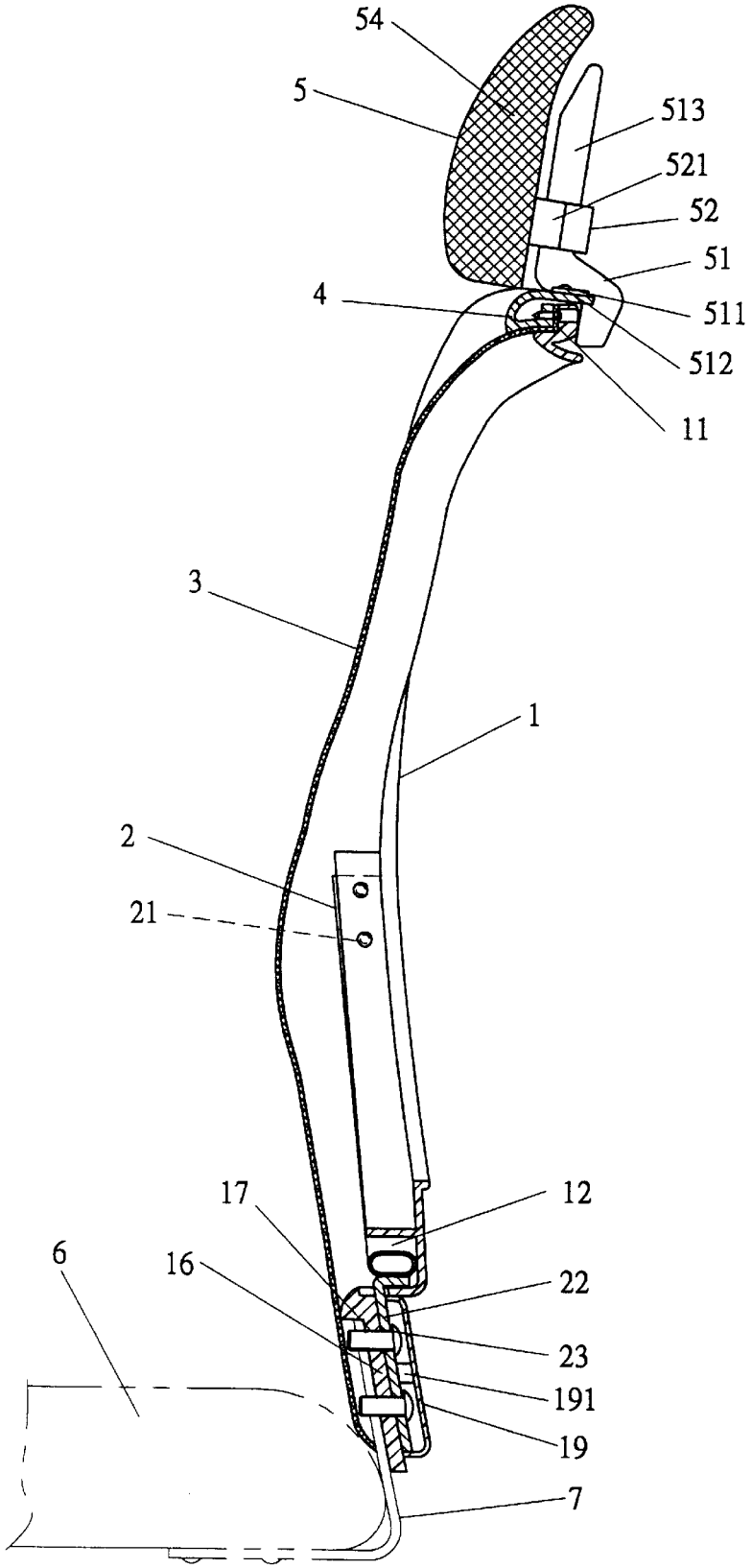
FIG. 3 is a sectional view of the chair backrest in accordance with the present invention.
Figure 4:
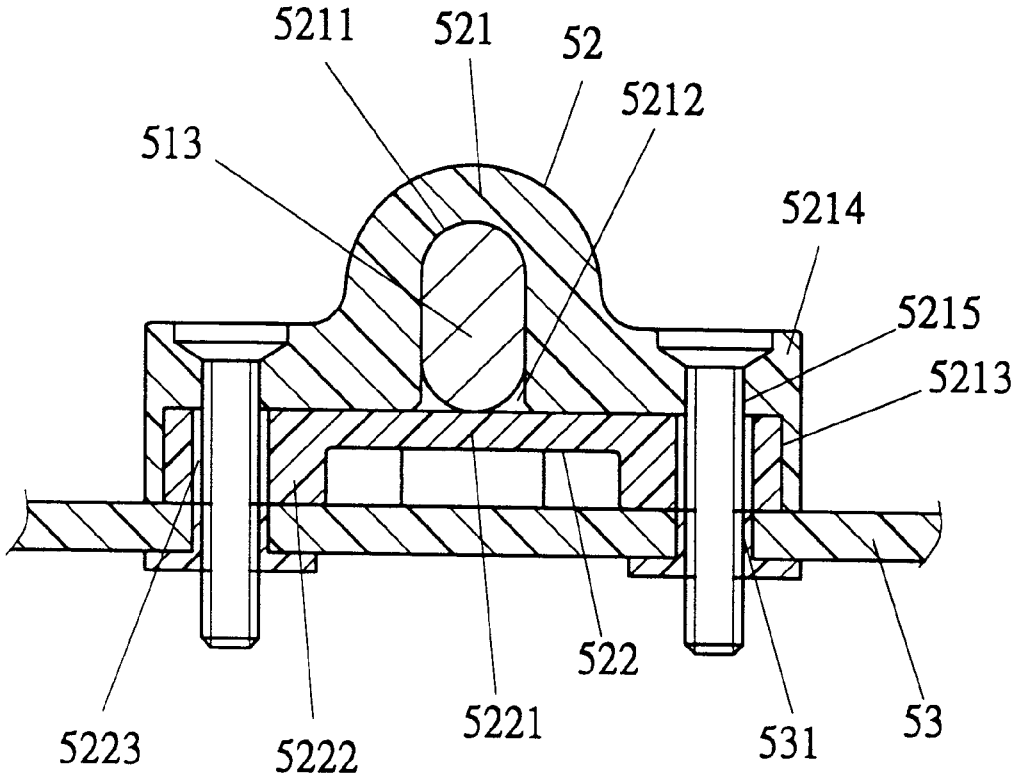
FIG. 4 is a sectional view illustrating a connecting member and an engaging rod for attachment of a pillow.

The frame 1 is a loop-like member made of a material (such as plastics) with proper flexibility. The frame 1 includes an outer peripheral face 11 along which the net 3 is mounted. The frame 1 further includes a substantially U-shaped groove 12 for securely receiving the substantially U-shaped support member 2. In this embodiment, as illustrated in FIG. 1, an inner U-shaped wall (not labeled) defining the U-shaped groove 12 includes fixing holes 13, and fasteners (not labeled) are extended through the fixing holes 13 of the inner U-shaped wall and fixing holes 21 of the U-shaped support member 2 that is preferably made of rigid material such as metal. In addition, the loop-like frame 1 includes an engaging portion 16 having a receiving groove 14 that is communicated with the U-shaped groove 12. An engaging piece 22 projects from the U-shaped support member 2 and extends into the receiving groove 14. Fasteners (not labeled) are extended through fixing holes 17 in the engaging portion 16, fixing holes 23 in the engaging piece 22, and fixing holes (not labeled) in an end of an attachment member 7 (FIG. 4) that is securely attached to a seat 6 of a chair at the other end. As illustrated in FIGS. 1 and 3, a lid 19 is provided to cover the engaging portion 16. The lid 19 includes engaging members 191 for releasably engaging with engaging holes 18 of the engaging portion 16, thereby covering the fasteners.

The net 3 is made of soft material and covers the frame 1, and fasteners (such as screws) are then provided to fix the net 3 on the frame 1. The outer member 4 is mounted to a peripheral edge of the net 3 that is located along the outer peripheral face 11 of the frame 1. The outer member 4 is substantially U-shaped and includes fixing holes 41 corresponding to fixing holes 15 of the frame 1. Fasteners (not shown) are extended through the fixing holes 41 of the outer member 4 and the fixing holes 15 of the frame 1.

The pillow device 5 includes a connecting frame 51, two connecting members 52, a base 53, and a pillow 54. The connecting frame 51 includes a connecting portion 511 with fixing holes 512 for connection with the backrest. The connecting frame 51 further includes two connecting portions 513 on both sides thereof.

Each connecting member 52 includes an outer cover 521 and a pressing plate 522. Each outer cover 521 includes a groove 5211 in a center thereof for receiving an associated one of the connecting portions 513 of the connecting frame 51. Each outer cover 521 further includes an opening 5212 and a receiving portion 5213 for receiving an associated one of the pressing plates 522. Further, the outer cover 521 includes an engaging portion 5214 and a fixing hole 5215 in each of two ends thereof. Each pressing plate 522 is resilient and includes a pressing portion 5221 in a center thereof. Further, each pressing plate 522 includes an engaging portion 5222 and a fixing hole 5223 in each of two ends thereof.

In assembly, the support member 2 is mounted in the U-shaped groove 12 of the frame 1 and then fixed by means of extending fasteners through the fixing holes 13 and 21. Next, the net 3 and the outer member 4 are assembled in a manner that the outer member 4 covers the net 3 and the frame 1 that is enclosed by the net 3, and fasteners are extended through the fixing holes 17 of the frame 1, the fixing holes 23 of the support member 2, and fixing holes of the attachment plate 7 that is securely attached to the seat 6. Thus, the backrest is attached to the seat 6. The lid 19 is then attached to the engaging portion 16 of the frame 1. Thus, the backrest and the seat 6 have improved engaging force therebetween, thereby increasing the supporting capability for the backrest by the support member 2.

Figure 5:
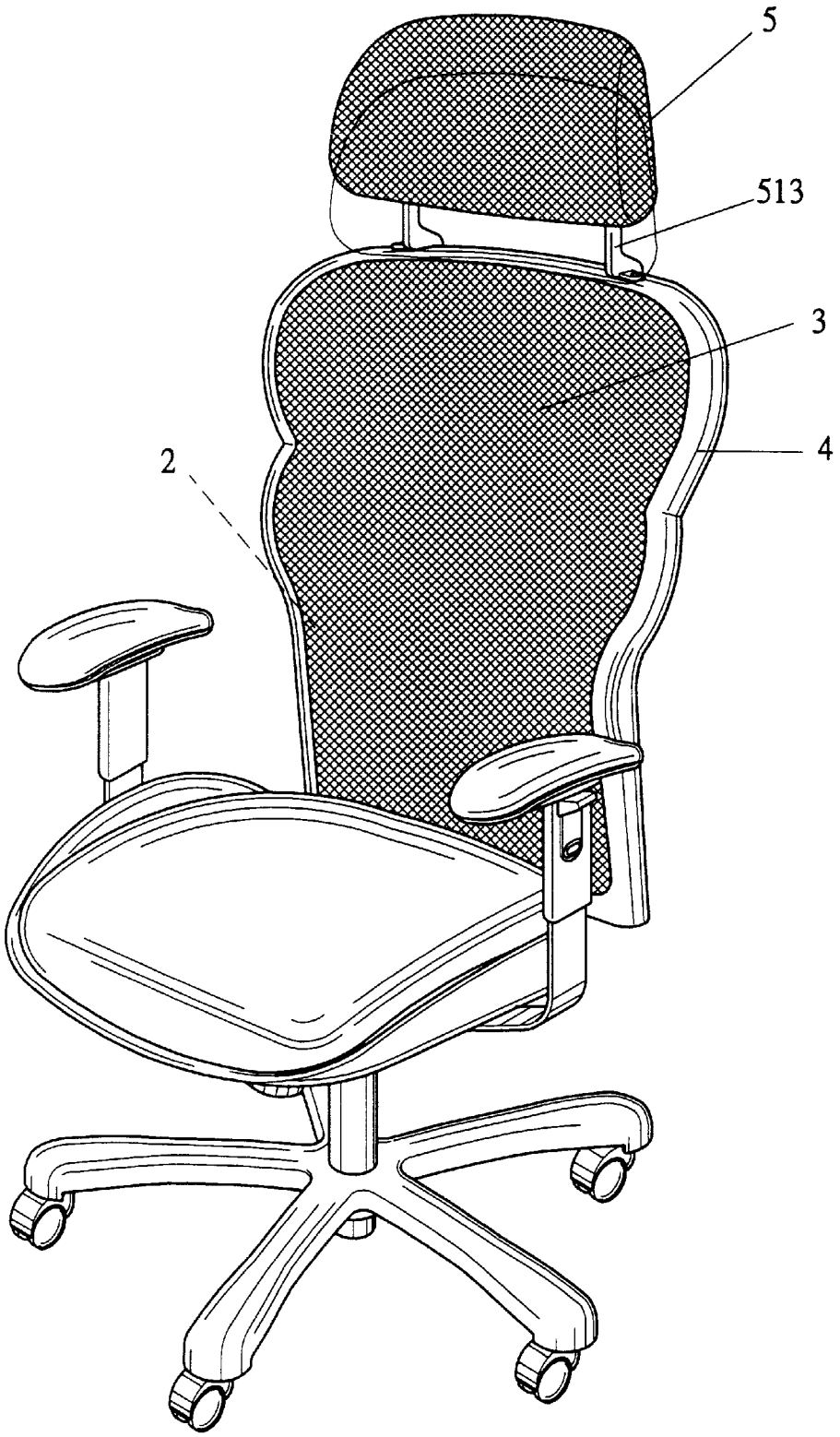
FIG. 5 is a schematic perspective view of a chair having the chair backrest in accordance with the present invention.
Figure 6:
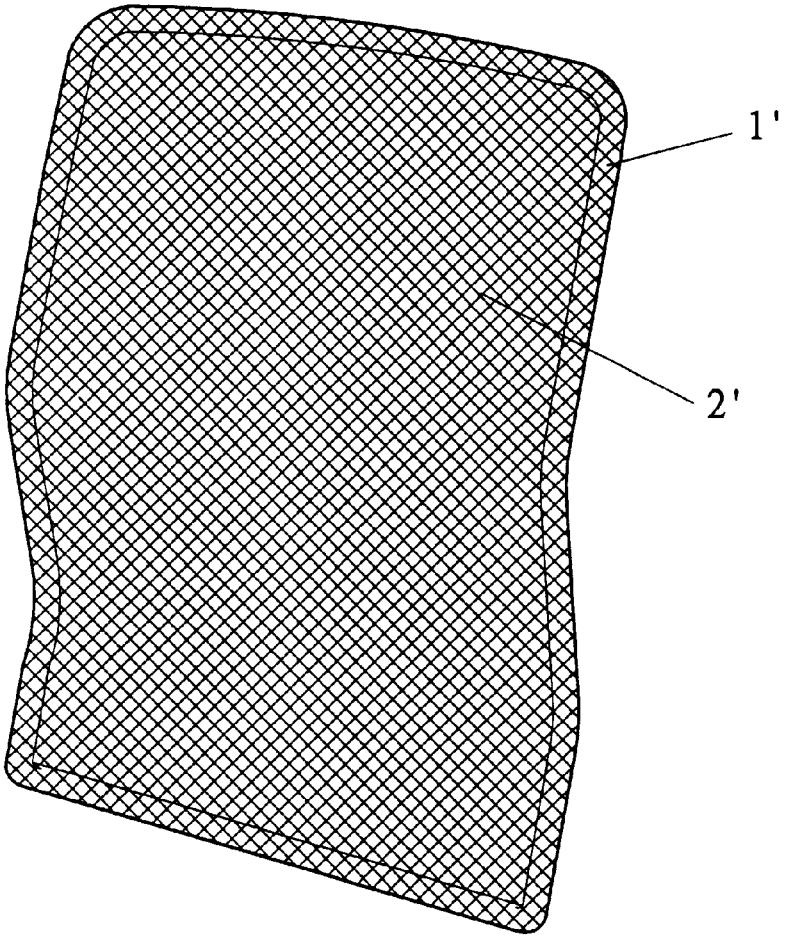
FIG. 6 (PRIOR ART)
FIG. 6 is a perspective view of a conventional chair backrest.

The connecting frame 51 of the pillow device 5 is engaged with an upper part of the backrest by fasteners. The outer covers 521 and the pressing plates 522 are engaged with the connecting portions 513 of the connecting frame 51, and fasteners are extended through the fixing holes 5215 of the outer covers 521, the fixing holes 5223 of the pressing pieces 522, and the fixing holes 531 of the base 53 to exert an appropriate force to the connecting portions 513 of the connecting member 51. Thus, the base 53 can be retained to the connecting portions 513 at a desired level (FIG. 4) by means of resiliency of the pressing plates 522. The user may apply a force to the base 53 to urge the connecting portions 513 of the connecting member 51 to move vertically to proceed with adjustment in the vertical position of the pillow 54, as shown in FIG. 5.

According to the above description, it is appreciated that the chair backrest in accordance with the present invention provides improved integrity and improved support reliability for the backrest after assembly. In addition, the engagement between the backrest and the seat is reinforced. Further, a pillow device can be attached to the backrest to increase comfort when supporting the user's head.

Although the invention has been explained in relation to its preferred embodiment, it is to be understood that many other possible modifications and variations can be made without departing from the scope of the invention as hereinafter claimed.

What is claimed is:

1. A chair backrest comprising:

a frame (1) that is a loop-like member and that includes a groove (12), the frame (1) further including an engaging portion (16) adapted to be securely connected to a seat of a chair, the frame (1) further including an outer peripheral face (11);

a support member (2) made of rigid material and mounted in the groove (12), the support member (2) including an engaging piece (22) securely connected to the engaging portion (16) of the frame (1); and a net (3) made of soft material, the net enclosing the frame (1) and including a peripheral edge mounted along the outer peripheral face (11) of the frame (1).

2. The chair backrest as claimed in claim 1, wherein the engaging portion (16) of the frame (1) includes a receiving groove (14) that is communicated with the groove (12), the engaging piece (22) of the support member (2) being inserted into the receiving groove (14) via the groove (12).

3. The chair backrest as claimed in claim 1, wherein a wall defining the groove (12) includes plural fixing holes (13), the support member (2) including plural fixing holes (21), further comprising fasteners extending through said plural fixing holes (13 and 21).

4. The chair backrest as claimed in claim 1, wherein the engaging portion (16) includes plural engaging holes (18), further comprising a lid (19) having plural engaging members (191) for securely engaging with said plural engaging holes (18), thereby covering said plural fasteners.

5. The chair backrest as claimed in claim 1, wherein the frame (1) includes plural fixing holes (15), further comprising an outer member (4) covering the net (3) along the peripheral edge of the net (3), the outer member (4) including plural fixing holes (41), further comprising fasteners extending through said plural fixing holes (15 and 41).

6. The chair backrest as claimed in claim 1, wherein the engaging piece (22) includes plural fixing holes (23), the engaging portion (16) including plural fixing holes (17), further comprising an attachment plate (7) including a first end having plural fixing holes and a second end securely attached to the seat of the chair, further comprising fasteners extending through said plural fixing holes (17) of the engaging portion (16), said plural fixing holes (23) of the engaging piece (22), and said plural fixing holes of the attachment plate (7).

7. The chair backrest as claimed in claim 1, further comprising a pillow attached to the backrest.

* * * * *